US008875898B2

(12) United States Patent
Hines et al.

(10) Patent No.: US 8,875,898 B2
(45) Date of Patent: Nov. 4, 2014

(54) METHOD FOR THE FROTH FLOTATION OF COAL

(75) Inventors: John B. Hines, Atlanta, GA (US); Dennis Kennedy, St. Paul, VA (US); Phillip W. Hurd, Conyers, GA (US)

(73) Assignee: Georgia-Pacific Chemicals LLC, Atlanta, GA (US)

( * ) Notice: Subject to any disclaimer, the term of this patent is extended or adjusted under 35 U.S.C. 154(b) by 1226 days.

(21) Appl. No.: 12/353,998

(22) Filed: Jan. 15, 2009

(65) Prior Publication Data

US 2009/0194466 A1 Aug. 6, 2009

Related U.S. Application Data

(60) Provisional application No. 61/026,316, filed on Feb. 5, 2008.

(51) Int. Cl.

| | |
|---|---|
| ***B03D 1/01*** | (2006.01) |
| ***B03D 1/008*** | (2006.01) |
| ***B03D 1/016*** | (2006.01) |
| ***B03D 1/02*** | (2006.01) |

(52) U.S. Cl.

CPC ..... *B03D 1/008* (2013.01)
USPC ..... 209/166

(58) Field of Classification Search

USPC ..... 209/166
See application file for complete search history.

(56) References Cited

U.S. PATENT DOCUMENTS

| | | | | |
|---|---|---|---|---|
| 1,585,756 | A | | 5/1926 | Borcherdt |
| 2,713,420 | A | | 7/1955 | Lord |
| 2,803,345 | A | | 8/1957 | Hutchinson Jacobs |
| 3,030,219 | A | | 4/1962 | Clark |
| 4,253,944 | A | | 3/1981 | Hefner, Jr. |
| 4,271,066 | A | | 6/1981 | Matsuo et al. |
| 4,305,815 | A | | 12/1981 | Hefner, Jr. |
| 4,330,339 | A | | 5/1982 | Nimerick |
| 4,340,467 | A | * | 7/1982 | Wang et al. ..... 209/166 |
| 4,410,431 | A | | 10/1983 | Roe |
| 4,415,337 | A | | 11/1983 | Kutta et al. |
| 4,447,344 | A | | 5/1984 | Roe |
| 4,474,619 | A | | 10/1984 | Meyer et al. |
| 4,504,385 | A | * | 3/1985 | Keys ..... 209/166 |
| 4,528,107 | A | | 7/1985 | McCaffrey et al. |
| 4,589,980 | A | | 5/1986 | Keys |
| 4,678,562 | A | | 7/1987 | Keys |
| 4,701,257 | A | | 10/1987 | Hefner, Jr. |
| 4,732,669 | A | | 3/1988 | Nimerick |
| 4,756,823 | A | * | 7/1988 | O'Neill et al. ..... 209/166 |
| 4,770,766 | A | | 9/1988 | Keller, Jr. et al. |
| 4,957,511 | A | | 9/1990 | Ljusberg-Wahren |
| 5,346,630 | A | | 9/1994 | Kenney |
| 5,379,902 | A | | 1/1995 | Wen et al. |
| 5,443,158 | A | | 8/1995 | McKenny et al. |
| 5,545,351 | A | | 8/1996 | Riggs et al. |
| 5,670,056 | A | | 9/1997 | Yoon et al. |
| 6,375,853 | B1 | | 4/2002 | Yoon |
| 6,526,675 | B1 | | 3/2003 | Yoon |
| 2003/0146134 | A1 | | 8/2003 | Yoon |
| 2005/0269248 | A1 | | 12/2005 | Cameron et al. |
| 2007/0187301 | A1 | | 8/2007 | Tran et al. |

FOREIGN PATENT DOCUMENTS

| | | | | |
|---|---|---|---|---|
| GB | 2093735 | A | | 9/1982 |
| GB | 2163975 | A | | 3/1986 |
| WO | 00/02662 | A | | 1/2000 |
| WO | WO2004/098782 | A1 | * | 11/2004 |
| WO | WO 2004098782 | A1 | * | 11/2004 |
| WO | 2006086443 | A | | 8/2006 |

OTHER PUBLICATIONS

Norlin et al. "Ullmann's Encyclopedia of Industrial Chemistry" [Online], Jun. 15, 2000, 14 pages, John Wiley & Sons, Inc., Retrieved from the Internet: URL:http://mrw.interscience.wiley.com/emrw/9783527306732/ueic/article/a26_057/current/pdf?hd%3DA11%2Ctall&hd%3DA11%2Coil.

Sis et al., "Comparison of non-ionic and ionic collectors in the flotation of coal fines", Minerals Engineering, Apr. 2003, pp. 399-401, vol. 16, No. 4.

Sis et al, "Utilization of Fine Coal Tailings by Flotation Using Ionic Reagents" Energy Sources, Aug. 10, 2004, pp. 941-949, vol. 26, No. 10, Taylor & Francis Inc., United States of America.

PCT International Search Report and Written Opinion of the International Searching Authority for PCT/US2009/031036, mailed Apr. 2, 2009, 10 pages.

PCT International Search Report and Written Opinion of the International Searching Authority for PCT/US2009/031035, mailed Apr. 7, 2009, 10 pages.

Groppo, J.G. et al., "Surface Chemical Control of Ultra-Fine Coal to Improve Dewatering," Coal Preparation, 1996, pp. 103-116, vol. 17, Overseas Publishers Association, Amsterdam, Netherlands.

Singh, B.P., "The Influence of Surface Phenomena on the Dewatering of Fine Clean Coal," Filtration and Separation, Mar. 1997, pp. 159-163.

Georgia-Pacific Chemicals LLC, Material Safety Data Sheet for XTOL® 0530 Rosin Fortified Distilled Tall Oil, effective date Oct. 30, 1997, six pages.

Georgia-Pacific Chemicals LLC, Material Safety Data Sheet for XTOL® 3030 Tall Oil Distillation Bottoms, effective date Nov. 11, 1997, seven pages.

Georgia-Pacific Chemicals LLC, Material Safety Data Sheet for LYTOR® 100 Tall Oil Resin, effective date Jan. 22, 2001, seven pages.

Georgia-Pacific Chemicals LLC, Material Safety Data Sheet for XTOLUBE® 1305 Lubricant Additive, effective May 2, 2001, six pages.

Georgia-Pacific Chemicals LLC, Material Safety Data Sheet for XTOLUBE® 1317 Lubricant Additive, effective Feb. 27, 2001, six pages.

Georgia-Pacific Chemicals LLC, Material Safety Data Sheet for XTOLUBE® 1320 Lubricant Additive, effective May 2, 2001, six pages.

(Continued)

*Primary Examiner* — Thomas M Lithgow
(74) *Attorney, Agent, or Firm* — Ram W. Sabnis

(57) ABSTRACT

The present invention relates to the beneficiation of coal by the process of froth flotation and specifically relates to a process for the froth flotation of coal using a collector consisting essentially of a fatty acid monoester of a polyol, a fatty acid diester of a polyol, or a mixture thereof.

20 Claims, No Drawings

(56) References Cited

OTHER PUBLICATIONS

Georgia-Pacific Chemicals LLC Material Safety Data Sheet for XTOL® 0520 Distilled Tall Oil, effective date Dec. 9, 2004, seven pages.

Georgia-Pacific Chemicals LLC, Material Safety Data Sheet for XTOL® 656 Mixed Tall Oil Acids, effective date Aug. 31, 2005, seven pages.

Georgia-Pacific Chemicals LLC, Material Safety Data Sheet for GP® 678G38 Mining Solvent, effective Sep. 27, 2007, six pages.

Georgia-Pacific Chemicals LLC, Material Safety Data Sheet for XTOL® 304 Tall Oil Fatty Acids, effective date Apr. 4, 2008, six pages.

Georgia-Pacific Chemicals LLC, Material Safety Data Sheet for XTOL® 101 Tall Oil Fatty Acids, effective date Apr. 14, 2008, six pages.

Georgia-Pacific Chemicals LLC, Material Safety Data Sheet for XTOL® 100 Tall Oil Fatty Acids, effective date Apr. 14, 2008, six pages.

Georgia-Pacific Chemicals LLC, Material Safety Data Sheet for XTOL® 300 Tall Oil Fatty Acids, effective date Apr. 14, 2008, six pages.

* cited by examiner

METHOD FOR THE FROTH FLOTATION OF COAL

FIELD OF THE INVENTION

The present invention relates to the beneficiation of coal by the process of froth flotation and specifically relates to a process for the froth flotation of coal using certain fatty acids esters as a collector.

BACKGROUND OF THE INVENTION

Most coals inherently contain some non-combustible mineral matter (reported as the ash value of the coal) that exists in close association with the combustible carbonaceous solids. In order to improve the value of such coals, such as the combustion value, it is necessary to remove as much of this mineral matter as possible. This beneficiation can be accomplished by finely dividing the coal and separating combustible coal particles from mineral-containing particles. Froth flotation is a common method used to beneficiate finely-divided coals. Conventional techniques involve the passage of air through a suspension of the finely-divided coal to create finely disseminated air bubbles which creates a froth and preferentially carries the carbonaceous coal particles to the surface.

Since the surface of coal is generally hydrophobic, it is possible to preferentially float finely divided coal particles from finely divided mineral matter (recovered in the tails) in the presence of a frothing agent, such as methyl isobutyl carbinol. In this way the combustion value of the finely-divided coal can be improved. Unfortunately, many coals have experienced some degree of surface oxidation, such as oxidized bituminous coals, which reduces the hydrophobicity of their surface and interferes with their ability to float. As a result, in the absence of any treatment to improve surface hydrophobicity of such coals, the tail fraction from the flotation may contain a significant fraction of combustible material, thus reducing flotation yield.

Substances used to enhance surface hydrophobicity and improve the yield of a coal flotation are known as collectors. Collectors are generally surface active reagents which preferentially wet or adsorb on coal surfaces. Water insoluble, neutral hydrocarbon liquids derived from petroleum, wood, or coal tars have usually been employed in the froth flotation of coal. Historically, a number of fuel oils have been used as collectors, such as diesel oil, kerosene, furnace oil, Bunker C fuel oil, and mixtures thereof to enhance the surface hydrophobicity of the combustible coal particles. In this way, the yield of reduced ash coal may be significantly improved.

Recently, conventional coal beneficiation practices have come under heightened environmental scrutiny. It has long been the practice of coal treatment facilities to discharge the recovered tailings by landfill. Unfortunately, the most commonly used fuel oil collectors are not environmentally friendly and regulations and/or legislation limiting or possibly prohibiting their use is anticipated.

As a result, efforts are underway to find more environmentally acceptable materials that will function effectively as collectors, i.e., that promote the flotation of the combustible coal particles in preference to the non-combustible mineral particles, in the established processes of beneficiating coal by froth flotation.

SUMMARY OF THE INVENTION

The present invention is directed to a froth flotation process for the beneficiation of coal, which process comprises the steps of (a) forming an aqueous slurry of the coal, (b) adding an effective amount of a collector consisting essentially of a fatty acid monoester of a polyol, a fatty acid diester of a polyol, or a mixture thereof, (c) subjecting the aqueous slurry of coal containing the collector to froth flotation, and (d) separating the floated material which comprises the beneficiated coal.

DETAILED DESCRIPTION OF THE INVENTION

The present invention provides a more environmentally friendly method for beneficiating coal by froth flotation. In particular, the present invention provides a process of froth flotation wherein an aqueous slurry of coal particles is mixed with a collector consisting essentially of a fatty acid monoester or diester of a polyol and the combustible coal particles in the coal slurry are preferentially floated. The collector preferably contains at least 90% by weight of a fatty acid monoester or diester of a polyol, and more preferably contains at least 95% by weight of a fatty acid monoester or diester of a polyol.

In particular, the present invention provides a froth flotation process for the beneficiation of coal, which process comprises the steps of (a) forming an aqueous slurry of the coal, (b) adding an effective amount of a collector consisting essentially of a fatty acid monoester or diester of a polyol (a polyhydric alcohol), (c) subjecting the aqueous slurry of coal containing the collector to froth flotation, and (d) separating the floated material which consists essentially of the beneficiated coal.

Testing conducted by applicants has demonstrated that the collectors of the present invention are for the most part at least comparable to, and may in many instances be superior to conventional, less environmentally acceptable fuel oil collectors previously used in this froth flotation application. Since the collectors used in accordance with the present invention do not pose an environmental hazard, they provide an environmentally friendly alternative to the conventional fuel oil collectors.

By requiring that the collector "consist essentially of" a fatty acid monoester or diester of a polyol, applicants intend to exclude both the concomitant use of fuel oil as a co-collector in the froth flotation method and the use of fatty acid triglycerides. If fuel oil is also included in the aqueous coal slurry, one destroys the environmental advantage inherent in the use of the disclosed fatty acid ester materials. The fatty acid triglyceides, on the other hand, are less efficient as a coal collector than the fatty acid monoesters and diesters. Thus, inclusion of any significant amount of fatty acid triglyceides in the collector can be expected to degrade performance. Fatty acid triglycerides should be present in an amount of less than 10% by weight of the collector, preferably less than 5% by weight and more preferably less than 1% by weight.

Broadly speaking, fatty acids and fatty acid derivatives employed for making the fatty acid monoesters and/or fatty acid diesters of polyols within the meaning of the present invention are derived from straight-chain or branched, saturated, mono- or polyunsaturated fatty acid radicals having 8 to 24 carbon atoms, in particular 12 to 22 carbon atoms and can be obtained from a variety of sources. Representative fatty acids include oleic acid, lauric acid, linoleic acid, linolenic acid, palmitic acid, stearic acid, ricinoleic acid, myristic acid, arachidic acid, behenic acid and mixtures thereof.

Through the use of known saponification techniques, a number of vegetable oils (triglycerides), such as linseed (flaxseed) oil, castor oil, tung oil, soybean oil, cottonseed oil, olive oil, canola oil, corn oil, sunflower seed oil, peanut oil, coconut oil, safflower oil, palm oil and mixtures thereof, to name just a few, can be used as a source of the fatty acid(s) for making a collector of the present invention. One preferred source of fatty acids is tall oil. One particular source of such preferred fatty acid is distilled tall oil containing no more than about 6% rosin acid and other constituents and referred to as TOFA (Tall Oil Fatty Acid).

As is known in the art, tall oil refers to the resinous yellow-black oily liquid obtained as an acidified byproduct in the Kraft or sulfate processing of pine wood. Crude tall oil (CTO), prior to refining, is normally a mixture of rosin acids, fatty acids, sterols, high-molecular weight alcohols, and other alkyl chain materials that cannot be saponified (neutral and non-saponifiable components). Distillation of crude tall oil is often used to recover a mixture of fatty acids in the $C_{16}$-$C_{20}$ range. The commercially available tall oil products XTOL®100, and XTOL®101 (all from Georgia-Pacific Chemicals LLC, Atlanta, Ga.), for example, all contain saturated and unsaturated fatty acids in the $C_{16}$-$C_{18}$ range, as well as minor amounts of rosin acids, and can serve as a source of fatty acid for preparing the fatty acid monoesters and/or fatty acid diesters of polyols of the present invention.

As recognized by those skilled in the art, it also is possible to use certain fatty acid derivatives for making the fatty acid monoesters and/or fatty acid diesters of polyols within the meaning of the present invention. Those skilled in the art recognize that such derivatives enter into esterification reactions in a manner similar to the parent fatty acids. Accordingly, such fatty acid derivatives as fatty acid halides, fatty acid anhydrides and fatty acid alkyl esters having 1 to 4 carbon atoms in the alcohol radical can be used as the fatty acid source and esters made from such materials are also considered to fall within the meaning of fatty acid monoesters of a polyol, and/or fatty acid diesters of a polyol.

Collectors of the present invention thus consist essentially of fatty acid monoesters and/or fatty acid diesters with polyols (polyhydric alcohols). Suitable polyols for reacting with fatty acids (or with fatty acid derivatives) include diethylene glycol, glycerol (glycerine), ethylene glycol, propylene glycol, polyethylene glycols, polypropylene glycols, cyclohexanediol, cyclopentanediol, polyethylene and polypropylene glycol copolymers, 1,3-propanediol, butyne-1,4-diol, 1,4-butanediol, 1,6-hexanediol, pentaerthritol, trimethylol propane, triethanolamine, diethanolamine, diisopropanolamine, dihydroxyacetone and biogenic polyhydric alcohols such as panthenol.

Another class of polyols or polyhydric alcohols considered useful for making fatty acid esters suitable for practicing the present invention are carbohydrates, in particular monosaccharides, oligosaccharides, polyglycerols and alkyl glycosides having 1 to 20 carbon atoms in the alkyl radical.

Monosaccharides can be selected from erythrose, threose, arabinose, ribose, xylose, glucose, mannose, galactose, fructose, sorbose, sorbitol, manitol and dulcitol. Oligosaccharides can be selected from disaccharides such as sucrose, trehalose, lactose, maltose and cellobiose, and trisaccharides, in particular raffinose. Sugar alcohols, such as selected from sorbitol, xylitol or erythritol, also are considered useful, so are the alkyl glycosides such as methyl glycoside.

Polyglycerols are ethers of glycerol, which are prepared industrially, for example, by base-catalyzed condensation of glycerol. These polyglycerols also occur as by-products of epichlorohydrin hydrolysis. The separation and isolation of the individual polyglycerols is possible by means of treatment with various agents. As the simplest condensation product, diglycerol and its higher oligomers are known as synthetic block-building substances, which are employed for a number of products. Fatty acid esters of these polyglycerols are thus also known in principle in the prior art. Within the meaning of the present invention, technical mixtures of polyglycerols are particularly preferably employed which customarily contain diglycerol, triglycerol, tetraglycerol and pentaglycerol.

Preferably, the polyhydric alcohols (polyols) have a molecular weight of less than about 1000, preferably less than about 500 and particularly less than about 300.

There are a variety of known methods for making fatty acid monoesters and diesters suitable for practicing the present invention. Such esters can be prepared by the catalytic reaction between a fatty acid (and/or a fatty acid derivative) and a polyol, or by a partial transesterification reaction between a triglyceride and a polyol. Thus, through the use of known partial transesterification techniques, vegetable oils can be used to produce such fatty acid monoesters and diesters. Various acid-type catalysts have been developed for conducting esterification reactions between fatty acids (and/or fatty acid derivatives) and polyols. Examples of the catalysts include cation exchange resins, single or complex metal oxides, metal salts, transition metal compounds, stabilized acids and synthesized zeolite. Esterification catalysts are available from Rohm & Haas under the Amberlyst® label.

It is also possible to make suitable monoesters and diesters by partially saponifying natural oils such as tallow, canola oil, castor oil, coconut oil, corn oil, cottonseed oil, eucalyptus oil, fish oil, linseed oil, menhaden oil, sardine oil, palm oil, palm kernel oil, peanut oil, rapeseed oil, safflower oil, soybean oil, sunflower oil, tung oil, and olive oil. In this case, mono and diesters of glycerol are made by the incomplete saponification reaction.

As noted above, triesters, such as the fatty acid triglycerides, should not be included in the collector in any significant amount, as they do not appear to perform as well as the monoesters and diesters.

Fatty acid monoesters and fatty acid diesters for use as a collector in accordance with the present invention also are commercially available. Such materials are sold by Georgia-Pacific Chemicals LLC as XTOLUBE® 1320 (a diester produced from tall oil fatty acid and diethylene glycol); and XTOLUBE®_1305 (a monoester produced from tall oil fatty acid and glycerol). Other fatty acid monoesters and fatty acid diesters also are believed to be available from Uniqema (part of the Croda Group) and from Cogins.

Coals to be beneficiated in accordance with the present invention can suitably be anthracite, lignite, bituminous, subbituminous and the like. The coal can be pulverized and cleaned using any available technology. Ultimately, an aqueous slurry of finely divided coal particles having a concentration of solids which promotes rapid flotation is prepared. Generally, a solids concentration of from about 2 to about 25 weight percent coal solids, more usually from about 5 to about 15 weight percent, is suitable.

The particle size of the coal flotation feed also is an important consideration. Generally particles larger than about 28 mesh (U.S. Sieve Size) are difficult to float so all of the particles should be of a smaller size, generally smaller than a No. 30 sieve *U.S. Standard Sieve Series (less than about 600 μm). Preferably, the coal particles to be treated in the process of the present invention have a particle size of less than 50 mesh (U.S. Sieve Series). More preferably, the coal particles have a particle size of less than 100 mesh.

The amount of collector suitably added to the aqueous coal slurry for obtaining the greatest recovery of combustible coal particles with an acceptable ash content is dependent upon such diverse factors as particle size, coal rank and degree of surface oxidation and the initial ash content of the coal feed, as well as the loading of frothing agent and other adjuvants. Generally, a suitable loading of the collector mixture can be determined by routine experiments. The phrase "effective amount" when used throughout the specification and claims is intended to denote the amount of the collector required to increase the recovery (yield) of ash-reduced coal by froth flotation in the presence of a frothing agent. Generally, when the collector mixture is employed with only a frothing agent, the collector is advantageously employed in a ratio of from about 0.001 to about 0.4 percent by weight, and more preferably from about 0.005 to about 0.1 percent by weight of coal solids fed to the flotation process, i.e., 0.1 to 2 pounds of collector per ton of coal).

The fatty acid ester collector of the present invention should be used in combination with a frothing agent. A frothing agent is used to promote formation of a suitably structured froth. Conventional frothing agents include pine oils, cresol, 2-ethyl hexanols, aliphatic alcohols such as isomers of amyl alcohol and other branched $C_4$ to $C_8$ alkanols, polypropylene glycols and ethers, methyl cyclohexyl methanols, and the like. Particularly suitable as frothing agents are methyl isobutyl carbinol (MIBC) and polypropylene glycol alkyl or phenyl ethers. The optimal amount of frothing agent to use in the flotation medium also is influenced by a number of factors, most important of which is the particle size, rank and degree of oxidation of the coal. Generally, an amount of from about 0.001 to 0.1 percent by weight frothing agent per weight of coal feed solids is suitable, more usually from 0.01 to 0.05 percent by weight.

The collector mixture of the present invention also can be used in combination with other environmentally acceptable (non-fuel oil) adjuvants and other additives that do not change the basic and novel characteristic of the environmentally friendly collector mixture, such as activators, conditioning reagents, dispersing reagents, depressing reagents, pour point depressants and freezing point depressants. As noted earlier, it is a critical feature of the present invention that conventional fuel oil collectors are not employed in the flotation medium and/or as a dispersing reagent.

The addition of a pour point depressant or a freezing point depressant to the collector mixture of the present invention is particularly useful in cold climates for maintaining the fluidity of the collector mixture. Suitable materials include fatty acids esters, particularly when esterified with a low molecular weight alcohol like ethanol or methanol, poly alkyl acrylates, poly alkyl methacrylates, copolymers of styrene and dialkyl maleates, copolymers of styrene and dialkyl fumarates, copolymers of styrene and alkyl acrylates, copolymers of styrene and alkyl methacrylates, alkylphenoxy poly(ethylene oxide) ethanol, alkylphenoxy poly(propylene oxide) propane diol, propylene glycol, ethylene glycol, diethylene glycol, acetate salts, acetate esters, chloride salts, formate esters, formate salts, glycerin, diesters of diacids, copolymers of dialkyl fumarates and vinyl acetate, copolymers of dialkyl maleate and vinyl acetate, copolymers of alkyl acrylate and vinyl acetate, copolymers of alkyl methacrylate and vinyl acetate, and the like usually in an amount of 5-60%, often 5-50% and usually 5-40%, by weight of the total solids in the collector mixture.

The aqueous coal slurry is desirably treated with the frothing agent and the collector of the present invention and any other adjuvants by vigorously mixing or agitating the slurry prior to flotation in a conventional manner. Generally for coal that is more difficult to float, it may be beneficial to mix the coal slurry with the collector for a period of time prior to initiating flotation, so as to obtain an intimate contact of the collector with substantially all of the coal.

The coal is generally floated at the natural pH of the aqueous coal slurry, which usually can vary from about 3.0 to about 9.5 depending upon the composition of the feed. However, the pH can optionally be adjusted to maintain the pH of the aqueous coal slurry prior to and during flotation at a value of from about 4 to about 9, more usually from about 5.5 to about 9. A pH in this range appears to promote a suitable level of coal recovery. If the coal is acidic in character, the pH can be adjusted using an alkaline material, such as soda ash, lime, ammonia, potassium hydroxide or magnesium hydroxide, with sodium hydroxide being preferred. If the aqueous coal slurry is alkaline in character, a carboxylic acid, such acetic acid and the like, or a mineral acid, such as sulfuric acid, hydrochloric acid and the like, can be used to adjust the pH, if desired.

The collector-treated and pH-adjusted aqueous coal slurry then is aerated in a conventional flotation machine or bank of rougher cells to float the coal. Any conventional rougher flotation unit can be employed and the present invention is not limited to any particular design of flotation equipment.

In further embodiments, the present invention is:

1. A froth flotation process for the beneficiation of coal, which process comprises the steps of (a) forming an aqueous slurry of the coal, (b) adding an effective amount of a collector consisting essentially of a fatty acid monoester of a polyol, a fatty acid diester of a polyol, or a mixture thereof, (c) subjecting the aqueous slurry of coal containing the collector to froth flotation, and (d) separating the floated material which comprises the beneficiated coal.
2. A process according to any of the previous and following embodiments wherein said aqueous slurry of coal contains 2 to 25 weight percent solids; wherein the particle size of said coal is less than 100 mesh; and wherein said collector is added at a level of about 0.005 to 0.1 percent by weight of coal solids.
3. A process according to any of the previous and following embodiments wherein a frothing agent is added to the aqueous slurry of coal.
4. A process according to any of the previous and following embodiments wherein the frothing agent is selected from the group consisting of methylisobutylcarbinol, pine oils, cresol, 2-ethyl hexanols, aliphatic alcohols, methyl cyclohexyl methanols, polypropylene glycols and polypropylene glycol alkyl or phenyl ethers.
5. A process according to any of the previous and following embodiments wherein said frothing agent is added at a level of about 0.01 to 0.05 percent by weight of coal solids.
6. A process according to any of the previous and following embodiments wherein the polyol of the fatty acid monoester or fatty acid diacid is selected from the group consisting of diethylene glycol, polyethylene glycol, glycerol and mixtures thereof.
7. A process according to any of the previous embodiments wherein the collector contains from 5 to 60% by weight of a pour point depressant or a freezing point depressant.

The following examples provide illustrative embodiments of the present invention and are not intended as a limitation on the scope of the invention. Unless otherwise indicated, all parts and percentages are by weight.

EXAMPLE 1

In a first series of substantially identical flotation tests conducted consistent with ASTM D 5114-90, Standard Test Method for Laboratory Froth Flotation of Coal in a Mechanical Cell, several different collector compositions were examined. The various collectors were added to an aqueous coal slurry in an amount of 0.50 pound of collector per ton of coal (an amount of 0.025 percent by weight of coal solids) and the resulting slurries were introduced into a flotation cell (Denver Laboratory Flotation Test Cell).

In each of these tests, approximately 100 grams of the same comminuted coal source or sample was diluted with prep. plant water to a slurry concentration of 5 percent solids by weight. The coal was a lower banner from Alpha Natural Resources (bituminous steam or met.) coal. The coal feed consisted essentially of particles smaller than about 100 mesh, U.S. standard sieve series. The same frothing agent, methyl cyclohexyl methanol (Surflot 944), was used in each of the tests at a level of 10 ppm. The pH was measured to be about 6.9.

Three separate series of tests were conducted, two at a float time of 3 minutes and one using a float time of 2 minutes. The weights and ash contents of the overhead, flotation concentrate (conc.) and of the tailings (tails) were measured and the percentage of the overall combustible material recovered in the concentrate (% comb. recovery) was calculated for each of the collectors. The results are presented in Table 1. Table 1 thus tabulates the identity of the collector for each run as well as the percent recovery of combustible coal and the ash content in the recovered concentrate.

TABLE 1

| Collector Tested | float time | mass (g) conc. | mass (g) tails | conc. % ash | tails % ash | % comb. recovery |
|---|---|---|---|---|---|---|
| Fuel Oil | 3 min. | 70.5 | 29.5 | 14.61 | 91.44 | 95.97 |
| XTOL ® 1317 | 3 min. | 67.9 | 32.1 | 12.66 | 88.84 | 94.30 |
| XTOL ® 1320 | 3 min. | 73.0 | 27.0 | 16.70 | 92.52 | 96.79 |
| XTOL ® 1305 | 3 min. | 69.9 | 30.1 | 14.83 | 90.70 | 95.51 |
| Fuel Oil | 3 min. | 60.9 | 39.1 | 13.48 | 88.50 | 92.14 |
| XTOL ® 1317 | 3 min. | 56.3 | 43.7 | 11.83 | 83.03 | 87.00 |
| XTOL ® 1320 | 3 min. | 63.4 | 36.6 | 16.17 | 88.88 | 92.89 |
| XTOL ® 1305 | 3 min. | 61.5 | 38.5 | 14.88 | 87.32 | 91.47 |
| Fuel Oil | 2 min. | 63.8 | 36.2 | 10.93 | 85.14 | 91.35 |
| XTOL ® 1317 | 2 min. | 60.8 | 39.2 | 10.67 | 79.02 | 86.85 |
| XTOL ® 1320 | 2 min. | 67.3 | 32.7 | 11.79 | 89.61 | 94.59 |
| XTOL ® 1305 | 2 min. | 66.1 | 33.9 | 11.36 | 87.15 | 93.08 |

XTOL ® 1320 is a commercial diester produced from tall oil fatty acid and diethylene glycol and is available from Georgia-Pacific Chemicals LLC, Atlanta, GA.
XTOL ® 1305 is a commercial monoester produced from tall oil fatty acid and glycerol and is available from Georgia-Pacific Chemicals LLC, Atlanta, GA.
XTOL ® 1317 is a commercial monoester produced from tall oil fatty acid and isobutyl alcohol (isobutanol) and also is available from Georgia-Pacific Chemicals LLC, Atlanta, GA The tests results show that the polyol fatty acid esters of the present invention provide a comparable degree of beneficiation when compared to a standard fuel oil collector and are superior to esters of the same fatty acids and a mono-alcohol (XTOLUBE® 1317). Indeed, in these tests XTOLUBE® 1320 and 1305 were consistently as good as, or better than fuel oil.

EXAMPLE 2

In a second series of substantially identical flotation tests conducted consistent with ASTM D 5114-90, Standard Test Method for Laboratory Froth Flotation of Coal in a Mechanical Cell, another set of collector compositions were examined. As in Example 1, the various collectors were again added to an aqueous coal slurry in an amount of 0.50 pound of collector per ton of coal (an amount of 0.025 percent by weight of coal solids) and the resulting slurries were introduced into the same flotation equipment used in the tests of Example 1.

In each of these tests, approximately 100 grams of the same comminuted coal sample was diluted with prep. plant water to a slurry concentration of 5 percent solids by weight. The same coal source used in example 1 was used. The coal feed consisted essentially of particles smaller than about 100 mesh, U.S. standard sieve series. The same frothing agent, Shurflot 944, was used in each of the tests at a level of 10 ppm.

In this Example, two separate series of tests were conducted, one at a float time of 3 minutes and one using a float time of 2 minutes. The weights and ash contents of the overhead, flotation concentrate and of the tailings were measured and the percentage of the overall combustible material recovered in the concentrates was calculated for each of the collectors. The results are presented in Table 2. Table 2 thus tabulates the identity of the collector for each run as well as the percent recovery of combustible coal and the ash content in the recovered concentrate.

TABLE 2

| Product Tested | float time | mass (g) Conc. | mass (g) tails | conc. ash (%) | Tails ash (%) | % comb. recovery |
|---|---|---|---|---|---|---|
| NONE | 3 min. | 48.6 | 51.4 | 12.56 | 70.51 | 73.71 |
| Fuel Oil | 3 min. | 55.1 | 44.9 | 8.93 | 83.65 | 87.24 |
| Soybean Oil | 3 min. | 57.0 | 43.0 | 10.69 | 84.04 | 88.12 |
| TOFA Diester of PEG 400 | 3 min. | 58.7 | 41.3 | 12.44 | 85.01 | 89.25 |
| NONE | 2 min. | 40.5 | 59.5 | 10.97 | 63.85 | 62.64 |
| Fuel Oil | 2 min. | 51.2 | 48.8 | 7.73 | 78.47 | 81.81 |
| Soybean Oil | 2 min. | 51.9 | 48.1 | 9.60 | 77.62 | 81.34 |
| TOFA Diester of PEG 400 | 2 min. | 55.0 | 45.0 | 10.63 | 81.31 | 85.39 |

The tests results show that the TOFA ester of the polyol (PEG 400) of the present invention provides a comparable (if not better) degree of beneficiation when compared to a standard fuel oil collector. Indeed, in these tests the TOFA ester was consistently as good as or better than fuel oil in the yield of combustible coal and was better than a common fatty acid triglyceride, i.e., soybean oil.

The present invention has been described with reference to specific embodiments. However, this application is intended to cover those changes and substitutions that may be made by those skilled in the art without departing from the spirit and the scope of the invention. Unless otherwise specifically indicated, all percentages are by weight. Throughout the specification and in the claims the term "about" is intended to encompass + or −5% and preferably is only about + or −2%.

We claim:

1. A froth flotation process for the beneficiation of coal, comprising:

adding an effective amount of a collector to an aqueous slurry of coal, wherein the collector comprises a fatty acid monoester of a polyol, a fatty acid diester of a polyol, or a mixture thereof, wherein the fatty acid of the fatty acid monoester and the fatty acid of the fatty acid diester are derived from a crude tall oil;

subjecting the aqueous slurry of coal containing the collector to froth flotation, wherein the collector contains at least 90% by weight of the fatty acid monoester of a polyol or a fatty acid diester of a polyol or mixtures thereof and the aqueous slurry of coal containing the collector when subjected to froth flotation contains less than 10 wt % of fatty acid triglycerides, based on the weight of the collector, and wherein the aqueous slurry of coal containing the collector is substantially free from fuel oil when subjected to froth flotation; and separating a floated material comprising a beneficiated coal.

2. The froth flotation process of claim 1, wherein the aqueous slurry of coal comprises about 2 wt % to about 25 wt % of coal solids, wherein the particle size of the coal is less than 100 mesh, and wherein collector is present in an amount of about 0.005 wt % to about 0.1 wt %, based on the weight of coal solids.

3. The froth flotation process of claim 2, further comprising adding a frothing agent to the aqueous slurry of coal.

4. The froth flotation process of claim 3, wherein the frothing agent comprises methylisobutylcarbinol, pine oils, cresol, 2-ethyl hexanol, aliphatic alcohols, methyl cyclohexyl methanol, polypropylene glycols, polypropylene glycol alkyl ethers, or polypropylene glycol phenyl ethers.

5. The froth flotation process of claim 4, wherein the frothing agent is present in an amount of about 0.01 wt % to about 0.05 wt %, based on the weight of coal solids.

6. The froth flotation process of claim 1, wherein the polyol of the fatty acid monoester of the polyol or the polyol of the fatty acid diester of the polyol is selected from the group consisting of: diethylene glycol, polyethylene glycol, glycerol, and mixtures thereof.

7. The froth flotation process of claim 1, wherein the collector comprises a pour point depressant or a freezing point depressant.

8. The froth flotation process of claim 1, wherein the fatty acid in the fatty acid monoester or the fatty acid diester comprises fatty acid derivatives selected from the group consisting of: fatty acid halides, fatty acid anhydrides, and fatty acid alkyl esters having 1 to 4 carbon atoms in the alcohol radical.

9. The froth flotation process of claim 1, wherein the aqueous slurry of coal containing the collector when subjected to froth flotation comprises the fatty acid triglycerides and in an amount of less than 5 wt % of the fatty acid triglycerides, based on the weight of the collector.

10. The froth flotation process of claim 1, wherein the aqueous slurry of coal containing the collector when subjected to froth flotation comprises the fatty acid triglycerides and in an amount of less than 1 wt % of the fatty acid triglycerides, based on the weight of the collector.

11. The froth flotation process of claim 1, wherein the aqueous slurry of coal containing the collector is free of fuel oil when subjected to froth flotation.

12. The froth flotation process of claim 1, wherein the collector contains at least 95 wt % of the fatty acid monoester of the polyol, the fatty acid diester of the polyol, or the mixture thereof.

13. The froth flotation process of claim 1, wherein the fatty acid monoester of the polyol is present.

14. The froth flotation process of claim 1, wherein the polyol of the fatty acid monoester of the polyol and the polyol of the fatty acid diester of the polyol comprise a carbohydrate.

15. A froth flotation process for the beneficiation of coal, comprising:

adding a collector to an aqueous slurry of coal, wherein the collector comprises:

a fatty acid monoester of a polyol, a fatty acid diester of a polyol, or a mixture thereof, wherein the fatty acid of the fatty acid monoester and the fatty acid of the fatty acid diester are derived from a tall oil, and wherein the tall oil is an acidified byproduct of a kraft process;

aerating the aqueous slurry of coal containing the collector, wherein the collector contains at least 90% by weight of the fatty acid monoester of a polyol or a fatty acid diester of a polyol or mixtures thereof and the aqueous slurry of coal containing the collector contains less than 10 wt % of fatty acid triglycerides, based on the weight of the collector, when aerated, and wherein the aqueous slurry of coal containing the collector is substantially free from fuel oil when subjected to froth flotation; and separating a floated material comprising a purified coal.

16. The froth flotation process of claim 15, wherein the collector contains at least 95 wt % of the fatty acid monoester of the polyol, the fatty acid diester of the polyol, or the mixture thereof.

17. The froth flotation process of claim 15, wherein the aqueous slurry of coal containing the collector when subjected to froth flotation contains less than 1 wt % of the fatty acid triglycerides, based on the weight of the collector.

18. The froth flotation process of claim 15, wherein the aqueous slurry of coal containing the collector when subjected to froth flotation contains less than 5 wt % of the fatty acid triglycerides, based on the weight of the collector.

19. The froth flotation process of claim 15, wherein the polyol of the fatty acid monoester of the polyol and the polyol of the fatty acid diester of the polyol comprise a carbohydrate.

20. The froth flotation process of claim 15, wherein the aqueous slurry of coal containing the collector is free of fuel oil when subjected to froth flotation.

* * * * *